US007732035B2

(12) United States Patent
Pedmo et al.

(10) Patent No.: US 7,732,035 B2
(45) Date of Patent: Jun. 8, 2010

(54) BASE FOR PLASTIC CONTAINER

(75) Inventors: Marc A. Pedmo, Brunswick, OH (US); James J. Miller, Barberton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 260 days.

(21) Appl. No.: 11/754,278

(22) Filed: May 26, 2007

(65) Prior Publication Data

US 2007/0231530 A1 Oct. 4, 2007

Related U.S. Application Data

(63) Continuation-in-part of application No. 29/255,302, filed on Mar. 7, 2006, now Pat. No. Des. 551,080.

(51) Int. Cl.
*B65D 1/42* (2006.01)

(52) U.S. Cl. ..... 428/66.3; 220/608; 220/623; 215/373; 215/375

(58) Field of Classification Search ..... 428/66.3; 215/373, 375; 220/608, 623
See application file for complete search history.

(56) References Cited

U.S. PATENT DOCUMENTS 5,005,716 A * 4/1991 Eberle ..... 215/373
5,503,283 A 4/1996 Semersky
D404,308 S 1/1999 Takahashi et al.
6,176,382 B1 * 1/2001 Bazlur Rashid ..... 215/373
6,296,131 B2 10/2001 Rashid
6,634,517 B2 10/2003 Cheng et al.
6,926,163 B2 8/2005 Darr et al.
7,017,763 B2 3/2006 Kelley
2004/0195199 A1 10/2004 Maki et al
2005/0127024 A1 6/2005 Darr
2006/0131257 A1 6/2006 Gatewood et al.

OTHER PUBLICATIONS

International Searching Authority/US/; International Search Report and Written Opinion for PCT/US08/64361, mailed Aug. 15, 2008.

* cited by examiner

*Primary Examiner*—Alexander Thomas
(74) *Attorney, Agent, or Firm*—Dykema Gossett PLLC

(57) ABSTRACT

A base for a plastic container is disclosed. The base includes a central vertical axis; an outer supporting annular portion for supporting said container on a surface; a central portion of the base, the central portion provided about said central vertical axis; and a base portion. The base portion extends between the annular portion and the central support portion of the base. The base portion includes at least two lugs that extend radially from a position adjacent the annular portion towards the central portion, the lugs including at least two stepped segments.

29 Claims, 6 Drawing Sheets

BASE FOR PLASTIC CONTAINER

CROSS-REFERENCE TO RELATED APPLICATION

This application is a continuation-in-part of U.S patent appplication Ser. No. 29/255,302, filed Mar. 7, 2006, now U.S. Pat. No. D551,080 for CONTAINER BASE, issued Sep. 18, 2007.

TECHNICAL FIELD

The present invention relates to base structures for plastic containers.

BACKGROUND

Today, a great number of plastic containers are filled with liquids and other contents. However, contents, including those involving carbonation or elevated temperatures, can subject the container to very high internal pressures. Containers have been designed to attempt to resist such pressure and to prevent undesired structural deformation. Dimensional stability is particularly important in the portions of the base that are intended to support the container with respect to an underlying surface. Consequently, there is a desire for base structures for plastic containers that provide improved support and/or dimensional stability.

SUMMARY

According to an aspect of the invention, a base for a plastic container is provided. The base includes a central vertical axis; an outer supporting annular portion for supporting said container on a surface; a central portion of the base, the central portion provided about said central vertical axis; and a base portion. The base portion extends between the annular portion and the central support portion of the base, and includes at least two lugs that extend radially from a position adjacent the annular portion towards the central portion. Each lug includes at least two stepped segments.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
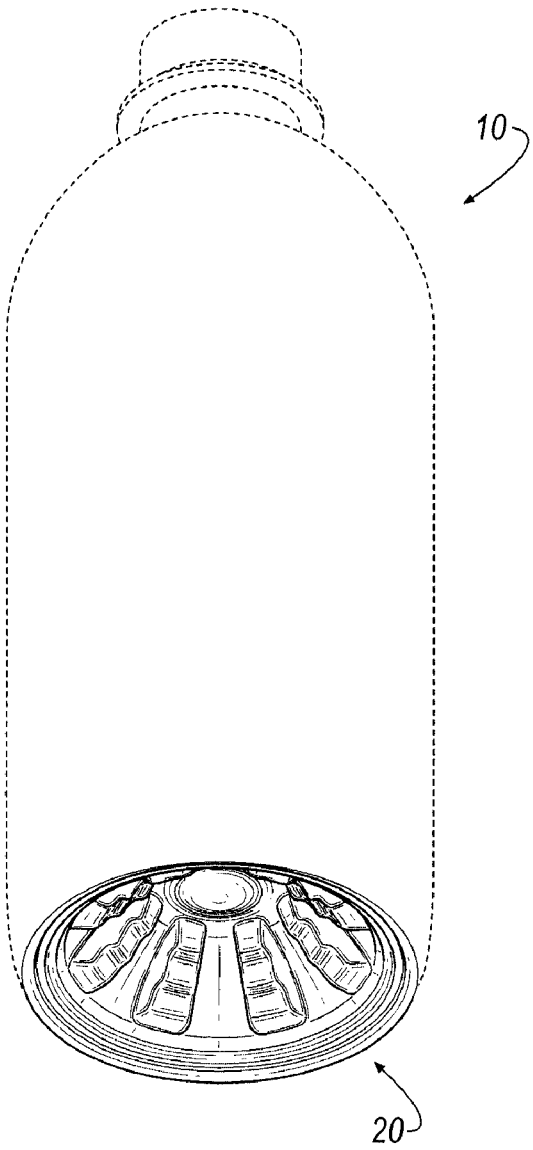
FIG. 1 is a perspective view of a plastic container including a base according to an embodiment of the invention.
Figure 2:
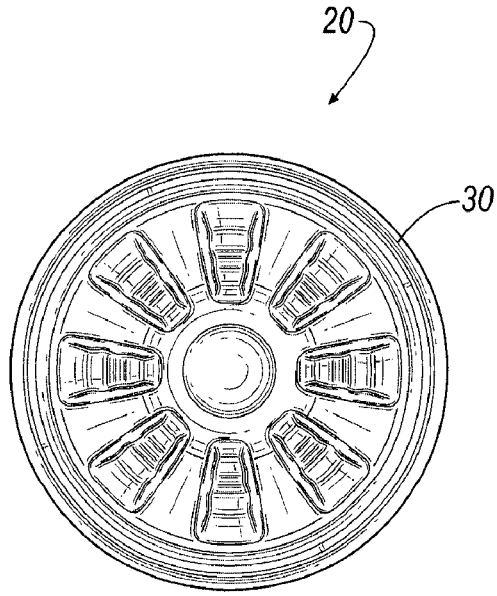
FIG. 2 is a bottom plan view of a base according to an embodiment of the invention.

FIG. 1 generally illustrates a plastic container 10 that includes a base 20 according to an embodiment of the present invention. As plan view of the base 20 depicted in FIG. 1 is generally shown in FIG. 2. The base 20 is shown having an outer supporting annular portion 30, a central portion 40, and a base portion 50 extending between the annular portion 30 and the central portion 40. The container 10, and consequently the base 20, may be comprised of a polymer, such as polyethylene terephthalate (PET) and may be biaxially oriented.

In the illustrated embodiment, base portion 50 includes a plurality of lugs 60 that extend radially from a position adjacent annular portion 30 towards central portion 40. The base portion also may include similar number of land portions 62 that are interspersed between lugs 60. In an embodiment, land portions 62 may be generally smooth (see, e.g., FIG. 5), and the surface area of lugs 60 may be greater than the surface area of the interspersed lands 62, both taken individually (i.e., compared on a one-to-one basis) and cumulatively (i.e., taken as a whole).

The embodiment of the base illustrated in FIG. 2 includes eight lugs 60. However, for example as shown in connection with the embodiments of the base shown in FIG. 3 (which includes six lugs), the invention is not limited to a configuration having eight lugs, and may instead include two or more lugs. Moreover, in an embodiment of the invention, each lug 60 may include two or more stepped segments.

In an embodiment, central portion 40 may be less than 0.125 inches deep (i.e., vertical height component), and may have a radius ranging from 0.125 inches to 0.750 inches. Moreover, for embodiments of the invention, the overall height of the base (i.e., measured from the highest point of the central portion 40 to the lowermost point of the base 20) may range from 0.300 inches to 1.000 inches.

Figure 3:
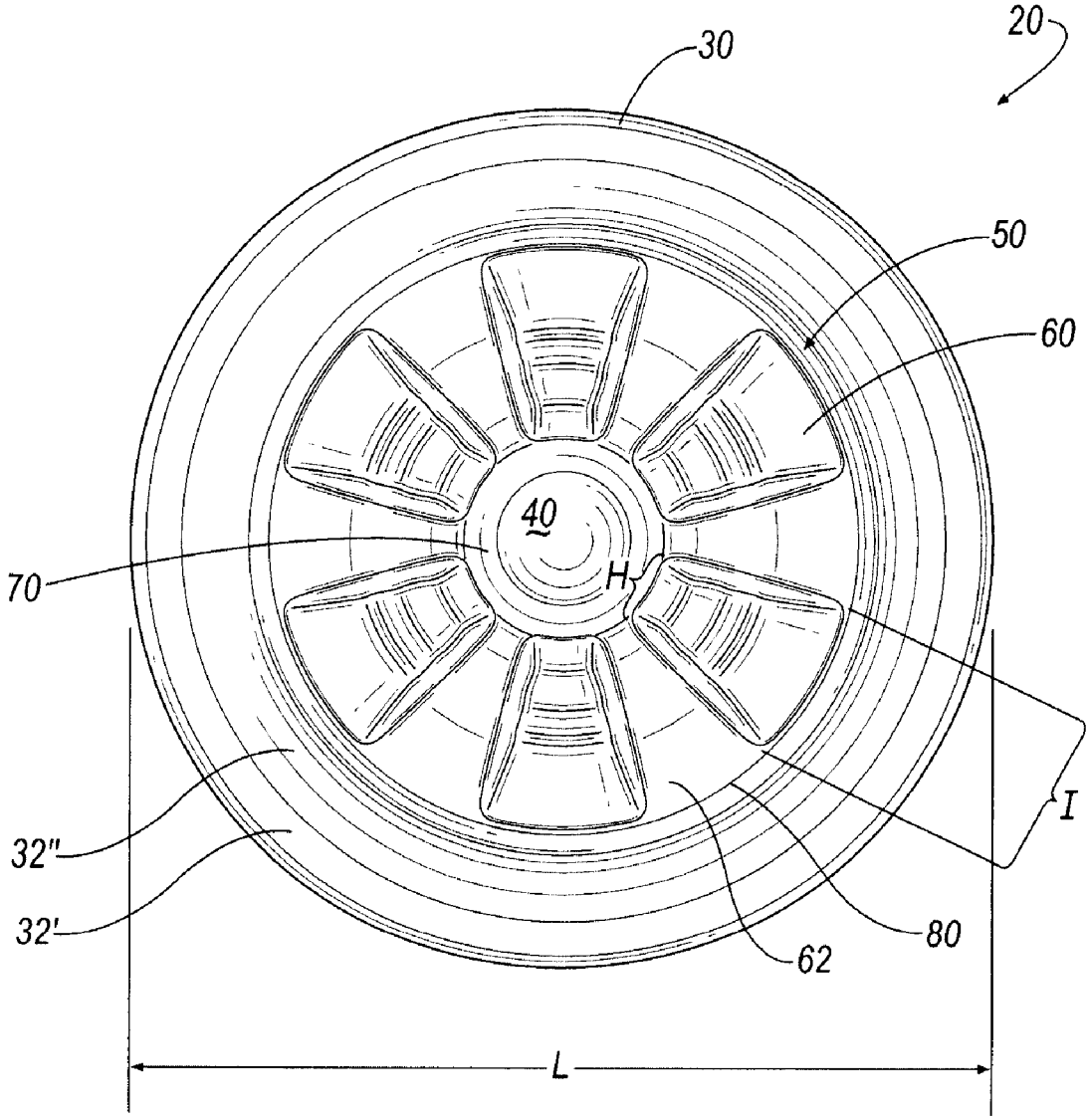
FIG. 3 is a bottom plan view of a base according to another embodiment of the invention.

Outer supporting annular portion 30 generally provides support for container 10 on a surface. As generally illustrated in FIG. 3, the base 20 may include a diameter L. Further, it is noted that the outer supporting annular portion 30 may be substantially uninterrupted, for example as generally illustrated in the figures, or may instead comprise one or more interrupted segments provided that portion 30 will provide adequate support for the container 10. The associated central portion 40 is generally provided about a central vertical axis, which is generally designated as A in the figures.

Figure 5A:
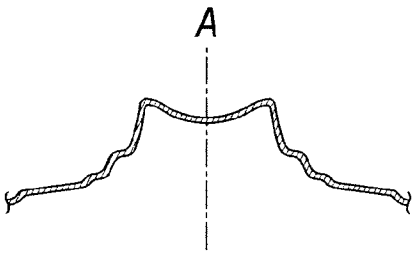
FIG. 5A is a cross-sectional profile of the base portion of FIG. 5 taken through a lug and generally viewed along lines A-A.
Figure 5C:
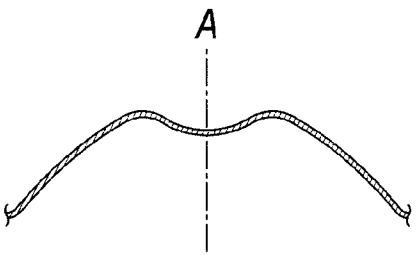
FIG. 5C is a cross-sectional profile of the base portion of FIG. 5B taken through a land and generally viewed along lines B-B.
Figure 6A:
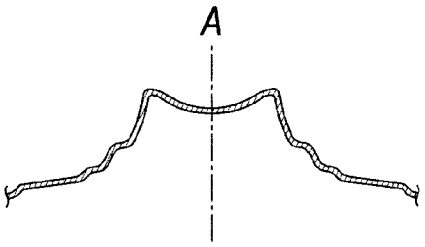
FIG. 6A is a cross-sectional profile of the base portion of FIG. 6 taken through a lug and generally viewed along lines A-A.
Figure 6C:
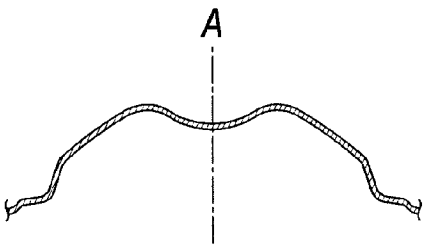
FIG. 6C is a cross-sectional profile of the base portion of FIG. 6B taken through a land and generally viewed along lines B-B.

With further reference to FIG. 3, the base portion 50 may include a central hub 70 that encircles or substantially surrounds central portion 40 of base 20, and/or an outer annular region 80 that is generally at or about the outer periphery of the base portion 50. In an embodiment, central portion 40 may comprise a push-down portion, which may, for example as generally illustrated in FIGS. 5C, 6C, and 7C, extend downwardly in a convex or inverse dome-like configuration. However, the invention is not limited to such a configuration, and for some embodiments central portion 40 may instead comprise a substantially flat portion, or even may include a push-up (e.g., upwardly convex or dome-like) portion.

In an embodiment, base 20 may further include an elevated ring portion 32 provided between outer supporting annular portion 30 and base portion 50. For some embodiments, such as that illustrated in FIG. 3, base 20 may include at least two elevated ring portions 32' and 32". When two or more elevated ring portions are provided, the elevated ring portions above said surface may progress in a radially inward direction relative to central axis A.

In an embodiment of the invention, such as generally illustrated in FIG. 3, lugs 60 extend into a portion of the outer annular region 80. For some embodiments, lugs 60 extend upwardly toward central portion 40, and lugs 60 may terminate in proximity to central portion 40, for example, in or in proximity to central hub 70. Lug 60 may have an arcuate length (or outer width) I at the segment most remote from the central portion 40, in addition to an arcuate length (or inner width) H at a segment nearest central portion 40. In an embodiment of the invention, H is less than I, and for some embodiments, H may be less than one-half I.

Lugs 60 may extend outwardly from the plane of base 20. Further, each lug 60 may include a stepped segment having a portion of the stepped segment that is on a common plane with the other stepped segments. Moreover, in an embodiment, a portion of each stepped segment (e.g., respective bottom segments) may be on a common horizontal plane.

Figure 4:
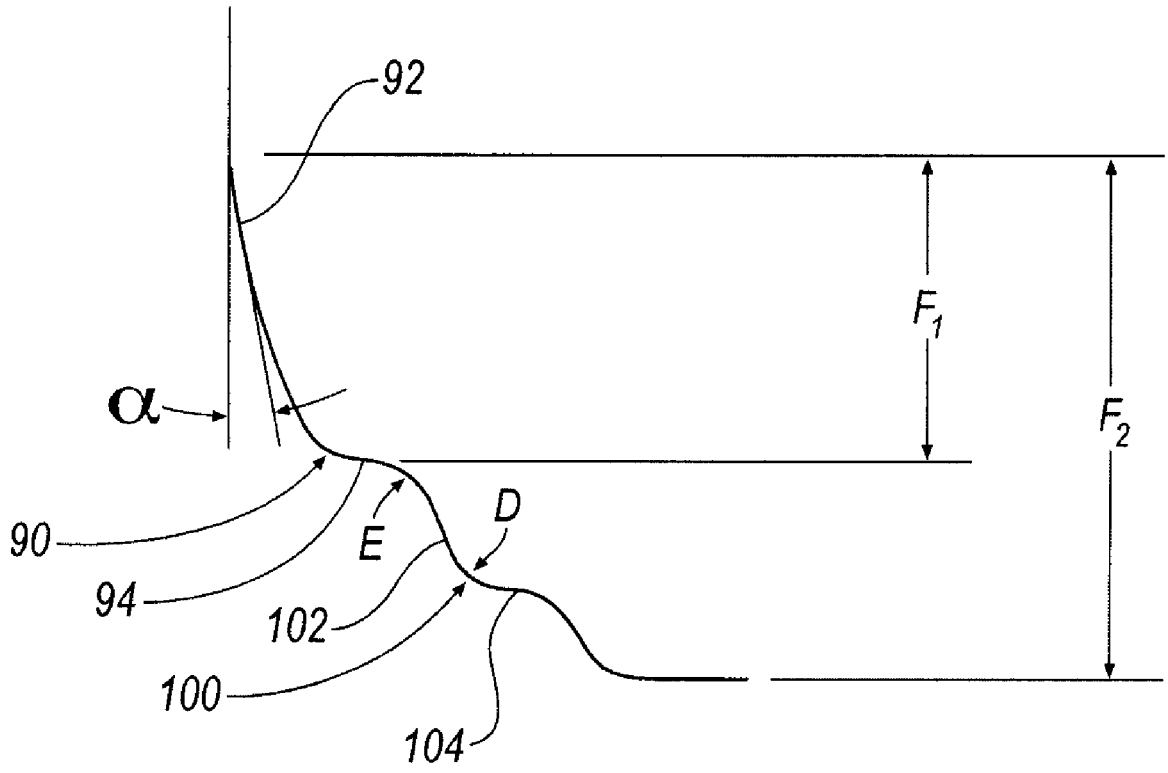
FIG. 4 represents a profile of a lug included in a base portion according to an embodiment of the invention.

As generally exhibited in FIG. 4, which generally illustrates an outer profile for a lug, including first and second stepped segments 90 and 100, respectively. For reference, in the illustrated embodiment, first stepped segment is closer to central portion 40 than second stepped segment 100. First stepped segment 90 includes a first vertical step segment 92 and a first bottom segment 94. First vertical segment 92 may extend downwardly from a position about central portion 40. In FIG. 3, the vertical length of first stepped segment from the central axis A point of the center portion 40 is generally represented by distance $F_1$. Similarly, second stepped segment 100 may include a second vertical step segment 102 and a second bottom segment 104, and may have a vertical length represented by distance $F_2$. In an embodiment of the invention, $F_1$ may, for example and without limitation be 0.277±0.100 inches, and $F_2$ may be 0.475±0.100 inches.

In an embodiment, first vertical segment 92 may have the greatest vertical height of the stepped segments 90, 100. As generally illustrated in FIG. 3, vertical segment 92 may form an angle a with respect to the vertical. In an embodiment, angle $\alpha$ is 1° or greater from vertical. Moreover, in an embodiment, the angle of the vertical segments for each successive stepped portion increases moving along the lug 60 in a direction moving away from central portion 40.

Additionally, the bottom segments 94,104 of first and second stepped segments 90,100 may range from about 0° to about 10° with respect to horizontal. Generally, the transition from the respective vertical segments to the bottom segments for each stepped portion will be curved and will provide an appropriate transition from a blow molding/formation perspective.

Moreover, as also generally illustrated in FIG. 4, lug 60 may include an inside radius D, and an outside radius E. In an embodiment, the inside radius D and outside radius E are minimum of 0.005 inches and a maximum of 0.250 inches. Further, as previously noted, the width (e.g., arcuate width) of each stepped segments of a lug may increase in a direction moving from central portion 40 toward outer supporting annular portion 30.

Figure 5:
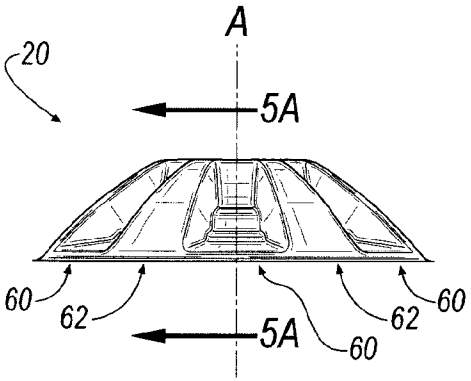
FIG. 5 is a side view of a base portion according to an embodiment of the invention.
Figure 5B:
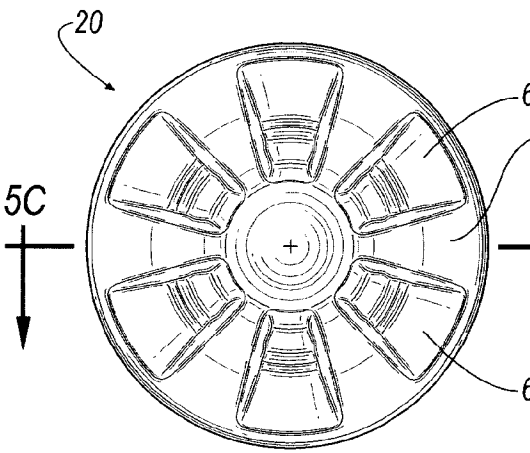
FIG. 5B is a bottom plan view of a base portion according to an embodiment of the invention.
Figure 6:
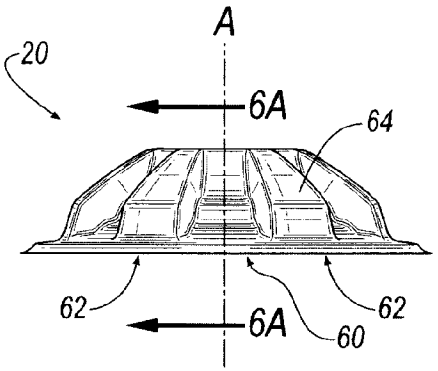
FIG. 6 is a side view of a base portion according to another embodiment of the invention.
Figure 6B:
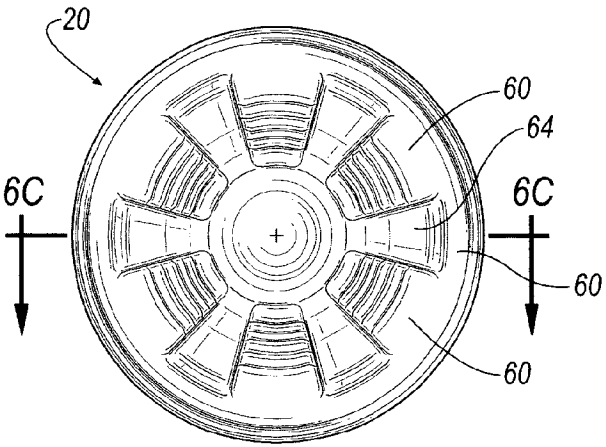
FIG. 6B is a bottom plan view of a base portion according to an embodiment of the invention.
Figure 7A:
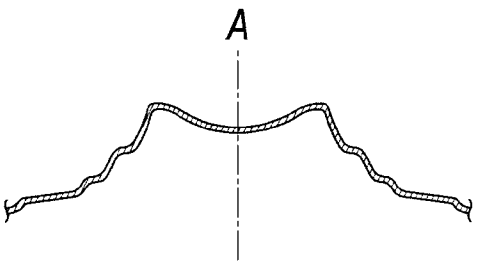
FIG. 7A is a cross-sectional profile of the base portion of FIG. 7 taken through a lug and generally viewed along lines A-A.
Figure 7C:
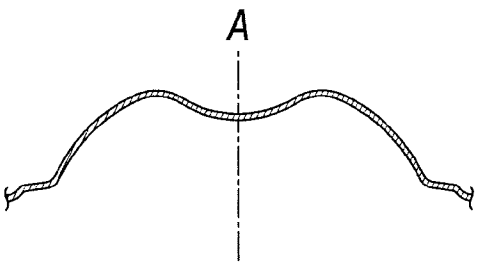
FIG. 7C is a cross-sectional profile of the base portion of FIG. 7B taken through a land and generally viewed along lines B-B.
Figure 7:
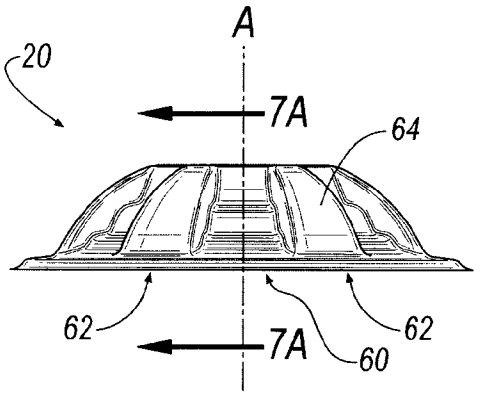
FIG. 7 is a side view of a base portion according to another embodiment of the invention.
Figure 7B:
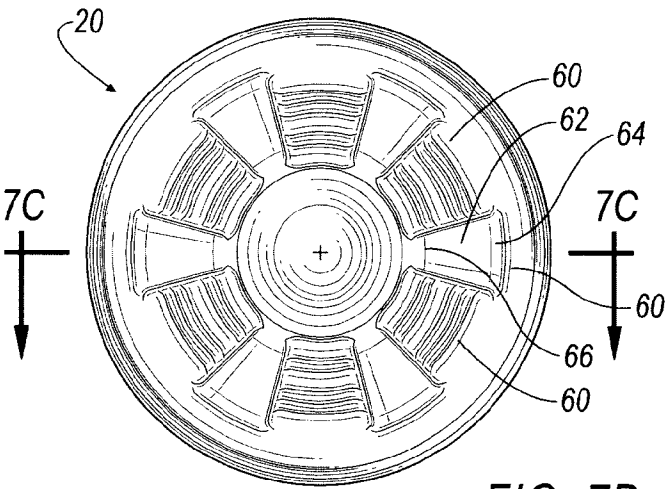
FIG. 7B is a bottom plan view of a base portion according to an embodiment of the invention.

By way of further examples, without limitation, additional views of bases according to embodiments of the invention are illustrated in FIG. 5 (including FIGS. 5A-5*c*), FIG. 6 (including FIGS. 6A-6C), and FIG. 7 (including FIGS. 7A-7C). T, while the bases 20 illustrated in such embodiments are shown having six lugs 60 and six lands 62

FIG. 5 generally illustrates a side view of a base portion according to an embodiment of the invention. A cross-sectional profile of the base shown in FIG. 5, taken through a lug, is generally shown in FIG. 5A. FIG. 5B illustrates a plan view of the base shown in FIG. 5. A cross-sectional profile of the base portion of FIG. 5B, taken through a land, is generally shown in FIG. 5C. As illustrated in FIGS. 5 and 5B, land 62 may be generally curved, and may proceed from an outer periphery of the base portion 50 toward the central portion 40 generally without interruption. As generally illustrated in FIGS. 5A and 5C, the respective high and low points for each stepped segment are generally on common horizontal planes and the respective innermost and outermost points for each stepped segment are at substantially the same radial distances from the centerline or axis A of the base. In embodiments of the invention, such as those illustrated in FIGS. 5A and 5C, the left and right profiles (viewed relative to the centerline) may substantially be mirror images of one another.

FIG. 6 generally illustrates a side view of a base portion according to another embodiment of the invention. A cross-sectional profile of the base shown in FIG. 6, taken through a lug, is generally shown in FIG. 6A. FIG. 6B illustrates a plan view of the base shown in FIG. 6. A cross-sectional profile of the base portion of FIG. 5B, taken through a land, is generally shown in FIG. 6C. As illustrated in FIGS. 6 and 6B, land 62 may include a first ring 64. Further, as generally illustrated in FIGS. 6A and 6C, the respective high and low points for each stepped segment are generally on common horizontal planes and the respective innermost and outermost points for each stepped segment are at substantially the same radial distances from the centerline or axis A of the base. In embodiments of the invention, such as those illustrated in FIGS. 6A and 6C, the left and right profiles (viewed relative to the centerline) may also substantially be mirror images of one another.

FIG. 7 generally illustrates a side view of a base portion according to yet another embodiment of the invention. A cross-sectional profile of the base shown in FIG. 7, taken through a lug, is generally shown in FIG. 7A. FIG. 7B illustrates a plan view of the base shown in FIG. 7. A cross-sectional profile of the base portion of FIG. 7B, taken through a land, is generally shown in FIG. 7C. As illustrated in FIGS. 7 and 7B, land 62 may include a first ring 64 and a second ring 66 that is closer to central portion 40. As generally illustrated in FIGS. 7A and 7C, the respective high and low points for each stepped segment are generally on common horizontal planes and the respective innermost and outermost points for each stepped segment are at substantially the same radial distances from the centerline or axis A of the base. In embodiments of the invention, such as those illustrated in FIGS. 7A and 7C, the left and right profiles (viewed relative to the centerline) may also substantially be mirror images of one another.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A base for a plastic container, the base having a central vertical axis and comprising:

an outer supporting annular portion for supporting said container on a surface;

a central portion of the base, the central portion provided about said central vertical axis; and a base portion extending between the annular portion and the central support portion of the base;

wherein the base portion includes at least two lugs that extend radially from a position adjacent the annular portion towards the central portion, each lug provided between the annular portion and the central portion; and each lug comprising at least two vertical segments and at least two bottom segments, each of the at least two bottom segments is substantially horizontal, and each of the at least two bottom segments is offset vertically from, and excludes, the central portion and the annular portion.

2. The base of claim 1, wherein the base portion includes an outer annular region surrounding the central portion of the base.

3. The base of claim 1, wherein a first vertical segment and a first bottom segment define a first stepped segment, the first vertical step segment extending downwardly from a position about the central portion.

4. The base of claim 3, wherein the first vertical segment of the first stepped segment is the greatest vertical height of the stepped segments.

5. The base of claim 3, wherein the first vertical step segment forms an angle that is one degree or greater from vertical.

6. The base of claim 1, wherein the angle of the vertical component of each stepped segment increases moving along the lug in a direction from the central portion.

7. The base of claim 1, wherein each of the bottom segments forms an angle with the horizontal that is from 0° to 10°.

8. The base of claim 1, wherein the lug includes an inside radius and an outside radius, and the inside radius and the outside radius are a minimum of 0.005 inches and a maximum of 0.250 inches.

9. The base of claim 1, wherein the width of the stepped segments of each lug increases in a direction moving from the central portion.

10. The base of claim 1, wherein the central portion has a vertical height that is less than 0.125 inches.

11. The base of claim 10, wherein the central portion has a radius from 0.125 inches to 0.750 inches.

12. The base of claim 1, wherein the overall height of the base is between 0.300 inches and 1.000 inches.

13. The base of claim 1, wherein the base portion includes six or more lugs.

14. The base of claim 1, wherein generally smooth land portions are interspersed between each of the at least two lugs.

15. The base of claim 14, wherein the surface area of the lugs is greater than the surface area of the interspersed lands.

16. The base of claim 1, wherein the central portion includes a convex portion that extends downwardly.

17. The base of claim 1, wherein the base is biaxially oriented.

18. The base of claim 1, wherein the base is comprised of polyethylene terephthalate.

19. The base of claim 1, wherein the lugs extend outwardly from the plane of the base.

20. The base of claim 1, wherein each of the lugs includes a stepped segment that includes a portion of the stepped segment that is on a common plane with the other stepped segments.

21. The base of claim 1, wherein the base includes an elevated ring portion between the outer supporting annular portion and the base portion.

22. The base of claim 21, wherein the base includes at least two elevated ring portions.

23. The base of claim 22, wherein elevation of the elevated ring portions above said surface increases in a radially inward direction relative to the central axis.

24. A base for a plastic container, the base having a central vertical axis and comprising:

an outer supporting annular portion for supporting said container on a surface;

a central portion of the base, the central portion provided about said central vertical axis; and a base portion extending between the annular portion and the central support portion of the base, the base portion including an outer annular region and at least two lugs that extend radially from a position adjacent the annular portion towards the central portion, each lug provided between the annular portion and the central portion; and each lug comprising at least two vertical segments and at least two bottom segments, each of the at least two bottom segments is substantially horizontal, and each of the at least two bottom segments is offset vertically from, and excludes, the central portion and the annular portion;

wherein the angle of the vertical segments increases moving along each lug in a direction from the central portion, and the widths of the stepped segments of each lug increases in a direction moving from the central portion.

25. The base of claim 1, wherein the outermost radial portion of the supporting annular portion extends to the outermost diameter of said container.

26. The base of claim 1, wherein the bottom segments of each lug do not circumferentially extend around the base portion.

27. The base of claim 1, wherein the substantially horizontal bottom segments range from about 0° to about 10° with respect to horizontal.

28. The base of claim 14 wherein the land portions includes a first ring.

29. The base of claim 14 wherein the land portions includes a first ring and a second ring, the second ring positioned closer to the central portion.

* * * * *